US005980144A

United States Patent [19]

DeBourg et al.

[11] Patent Number: 5,980,144

[45] Date of Patent: Nov. 9, 1999

[54] MANUAL DISPENSER FOR THERMOPLASTIC MATERIAL

[75] Inventors: Jean-Pierre DeBourg, Lyons; Daniel Bontoux, Saint Genis Laval, both of France

[73] Assignee: SEB S.A., Ecully, France

[21] Appl. No.: 08/942,281

[22] Filed: Oct. 1, 1997

[30] Foreign Application Priority Data

Oct. 2, 1996 [FR] France ..... 96 12209

[51] Int. Cl.[6] ..... A46B 11/08

[52] U.S. Cl. ..... 401/1; 401/2

[58] Field of Search ..... 401/1, 2, 208, 401/220

[56] References Cited

U.S. PATENT DOCUMENTS

| | | | |
|---|---|---|---|
| 3,103,689 | 9/1963 | Borisof . | |
| 3,228,566 | 1/1966 | Knox, Jr. | 401/1 |
| 4,373,441 | 2/1983 | Messerschmitt . | |
| 4,376,008 | 3/1983 | Lauri et al. . | |
| 4,773,784 | 9/1988 | Mann | 401/1 |
| 5,219,237 | 6/1993 | Zonneveld | 401/1 |
| 5,681,388 | 10/1997 | Legrain et al. | 401/1 |

FOREIGN PATENT DOCUMENTS

| | | |
|---|---|---|
| 0 423 399 | 4/1991 | European Pat. Off. . |
| 0 499 317 | 2/1992 | European Pat. Off. . |
| 914 405 | 9/1945 | France . |
| 1164446 | 1/1967 | United Kingdom . |
| 2 162 585 | 8/1984 | United Kingdom . |

*Primary Examiner*—David J. Walczak
*Attorney, Agent, or Firm*—Pillsbury Madison & Sutro

[57] ABSTRACT

Hand held dispenser for thermoplastic material including a casing forming a manual holding element and enclosing a space for receiving a mass of thermoplastic material in a solid state, the casing having an open outlet end communicating with the space; a component for advancing the thermoplastic material toward the open end of the casing, and a heating element for heating the thermoplastic material to a flowable state, wherein the heating element has a low thermal inertia, is arranged in a substantially homogeneous manner across a surface disposed opposite the open end and having dimensions which correspond to dimensions of the open end and wherein the heating element further acts to distribute thermoplastic material in a flowable state in the form of a sheet on a receiving surface.

34 Claims, 9 Drawing Sheets

MANUAL DISPENSER FOR THERMOPLASTIC MATERIAL

BACKGROUND OF THE INVENTION

The present invention relates to a manual dispenser of thermoplastic material, particularly depilatory wax. However, such dispenser can also be used for dispensing products having the form of a cream, an ointment, a glue, or a varnish.

In the present specification, thermoplastic materials are intended to encompass all types of materials which assume a solid, semi-solid or pasty physical state at normal room temperature, and are transformed into a liquid or flowable state by application of heat, which then permits, among other things, the material to be spread so as to form a thin layer on a surface. In this dispenser, the material stored in a solid physical state, or form, at normal room temperature can be subjected to a heat flow in order to change into a fluid, and particularly liquid, state in order to be dispensed in the form of a thin layer.

Generally, such a dispenser includes a housing which is constructed to be hand-held, with the interior of the housing being provided with a reservoir containing the thermoplastic material in its solid form. Such solid form can be in the form of granules or a block or bar of, for example, wax. This reservoir can contain means to push the wax toward its outlet, the wax then emerging onto means for distributing a thin layer of molten wax. These distributing means can include an intermediate conduit terminated by an opening from which the layer is deposited directly on a receiving surface, the surface typically being constituted by the skin of a user. Alternatively, the reservoir can have an outlet which opens onto a receiving surface constituted by a transfer surface of an application means, such as a roller for transferring the layer of material onto a surface.

The reservoir, the distribution and/or transfer means and the application means are in thermal communication with heating means to melt the totality or only a proximal portion of the wax in a manner such that, once the wax is in a liquid or flowable state, it flows out of the distributing means in the form of a layer or a band whose thickness depends at least in part on the speed of displacement of the dispenser which moves directly above the application surface, or the peripheral surface speed of the roller. Once the band of wax has been applied to the skin, a band of gauze or of plastic is placed on the wax layer in order to adhere to the wax after the wax has cooled and solidified. When the gauze or plastic band is pulled away from the user's skin, the wax layer is pulled away at the same time, resulting in the removal of hairs which have become imprisoned in the wax layer.

A first type of dispenser permits relatively rapid melting of the extremity of a stick of wax which is pushed through a hot passage whose temperature is controlled and whose outlet opening serves to distribute dots or stripes of wax.

European Patent Document EP-A-0055157 describes such a type of dispenser particularly intended for depilatory removal of hair from the face. In this dispenser, wax in the form of a stick contained in a reservoir is pushed manually into a passage having a first straight part which is surrounded by a heating resistance. Once the wax has been heated to a flowable state, it flows into a second, bent intermediate part of the passage, this second part opening into a dispensing orifice. In order to prevent the melted wax from cooling during its passage through the second part, the passage is made of a material which is a good conductor and accumulator of heat.

In U.S. Pat. No. 1,449,517, a stick of thermoplastic material is pushed manually by means of a toothed wheel into an intermediate heating passage having a conical form with a circumference which decreases toward the outlet. This heating passage is equally composed of a massive metal material and thus requires a long period of time to be heated and has a high degree of thermal inertia.

French Patent Document FR-A-914405 describes an electric dispenser to form wax tablets. In this structure, there is an intermediate dispensing neck downstream of and relatively remote from heating means which are disposed at the outlet of the reservoir containing the stick.

Heating means of dispensers for sticks of wax described above generally have a non-negligible thermal inertia, while the sticks of wax have a relatively low thermal conductivity. The utilization of this type of dispenser is thus tricky since, when the heating means are turned off, passages in contact with the wax do not cool instantaneously, so that the wax continues to melt and flow out of the reservoir for a certain length of time. This additional wax then comes to adhere against the walls of the passage and other adjacent intermediate walls. This causes subsequent restarting of the dispenser to be difficult since it is then necessary to wait not only until the heating passage has returned to its working temperature, but also until all of the wax present in the downstream part of the dispenser has also melted, with the risk that the totality of the stick softens and renders the dispenser unusable as a result of a complete clogging.

Above all, in the dispensers described previously, the wax is heated at its outer surface, i.e. over a surface which is substantially parallel to the axis of displacement of the wax. In addition, it is very difficult to cause the heat to reach the center of the block or stick of wax taking into account the low thermal conductivity of such material. This leads to a local overheating of the wax to accelerate the transfer of heat, thus aggravating the inertia effects of the heating element and creating risks relating to the final application temperature.

German Patent Document DE1 954 812 describes moreover dispensers of mastic which include a main peripheral heating at the level of the outlet of the reservoir opening into a conical intermediate volume which itself terminates at a distribution point. In the embodiment show in FIGS. 4 and 5 of this publication, provision is made for a supplemental heating by means of four electrical resistances arranged in the reservoir outlet in the form of a transverse cross, these being situated upstream of the intermediate conical volume. However, the center of the mastic quadrants thus cut longitudinally in the stick which are still essentially solid when they arrive in the conical intermediate volume where an equalization of the melting is to be effectuated. In addition, when the heating is turned off, the entirety of the surrounding mastic zone is solidified into a single block and it thus takes a long time to soften this material when the heating is restarted despite the arrangement of the heating in the form of a transverse cross.

U.S. Pat. No. 2,272,780 describes a dispenser for meltable colored material used to decorate textiles, this dispenser including heating means constituted by a radiator mounted on electric resistances in the middle of an intermediate chamber situated at the outlet of a reservoir, this chamber opening onto a distributing ball valve. As shown in the drawings of this patent document, the radiator is present in the form of a transversal disk surmounted in the downstream direction by four blades arranged in the form of a cross, the molten material having to flow around the disk in order to reach the valve. This radiator is relatively massive and, when the heating means are shut off, the material solidifies in all of the chamber, which retards subsequent restarting of the dispenser.

A second type of dispenser, called a "roller dispenser", permits spreading of a layer of wax in the form of a band on an application surface and is described in the patent documents FR-A-2520601, FR 2 706 261, EP 499 317 and U.S. Pat. Nos. 3,103,689 and 5,556,468. These dispensers comprise a transfer and application roller disposed across the outlet of an intermediate zone situated in an extension of a reservoir outlet, the space between this intermediate zone and the roller constituting the surface for distributing the wax as a sheet on the periphery of the transfer roller.

In the embodiment according to the document FR-A-2520601, the dispenser is preliminarily installed in a heating sleeve within a support housing for the time necessary for the entirety of the wax contained in the reservoir to melt. Therefore, the time that one must wait until the dispenser is ready for use is particularly long.

In the embodiment described in FR 2 706 261, and U.S. Pat. No. 5,556,468 a reservoir made of aluminum includes a central diffusion blade and is heated by an electric resistance placed against one of its longitudinal walls. It is equally necessary, in this case, to wait until all of the wax in the reservoir is melted before being able to use the dispenser.

In the embodiments disclosed in the documents EP 499 315 and U.S. Pat. No. 3,103,689 a single electrical resistance is arranged in the intermediate zone slightly above and parallel to the roller. If desired, the resistance is completed by a fin which is oriented toward the roller in order to also heat it. Starting of the dispenser can only commence after all of the wax present in the intermediate zone has melted.

In summary, depilatory hair removal can generally begin in these configurations only when the totality of the wax present in the reservoir and/or in the intermediate zone at the outlet of which the roller is located has melted and comes in contact with the transfer surface of the applicator roller, which requires the user to wait for a non-negligible time after having turned the dispenser on. This waiting time is undesirable because it prevents a rapid hair removal operation when the user is in a hurry.

Conversely, when the hair removal operation has ended and the user turns off the heating means, the remainder of the molten wax continues to move forward during a certain time period and accumulates between the heating means and the roller, where that wax solidifies. This phenomenon of blocking the space between the outlet and the distribution element then results in possible complete blockage of the applicator roller against rotation. When the dispenser is again placed in operation, this portion of the wax will require even more time to melt since it is not in direct contact with the heating means.

Moreover, the thickness of the band of wax is hard to control by the user because it is linked to the geometry and the composition of the wax.

BRIEF SUMMARY OF THE INVENTION

An object of the present invention is to provide manual dispensers of thermoplastic material, particularly depilatory wax, permitting, when they are placed in operation, a nearly instantaneous melting and dispensing of a first quantity of wax to be applied, which wax is stored in the reservoir in the form of large granules or in the form of a solid bar or block.

These dispensers will equally prevent, when operation is halted, the melting of residual wax which would otherwise resolidify in the form of residues close to the distribution outlet, and this in order to facilitate subsequent restarting of the dispenser.

Dispensers according to certain embodiments the invention can also permit control, particularly adjustment to a predetermined value, of the thickness of the applied wax band or sheet.

A dispenser according to the present invention has a relatively simple structure to assure a reliable operation over a long period of time and to minimize fabrication and assembly costs.

The above and other objects are achieved, according to the present invention, in a manual dispenser for thermoplastic material, notably depilatory wax, comprising a casing which is constructed to be held in the user's hand and within which is provided a reservoir, or a receptacle, for solid thermoplastic material in the form of granules or in the form of a bar. This dispenser is completed by means for advancing the thermoplastic material toward an outlet surface of the reservoir or receptacle. The dispenser also comprises means for heating the thermoplastic material. More particularly according to the invention, the heating means, having a low thermal inertia, are arranged in a substantially homogeneous manner over the entire surface corresponding to, or parallel, close to and downstream of, the outlet surface of the reservoir of which it takes the dimensions, these heating means constituting the means for distributing molten wax in a sheet, band, or layer, on an application surface or a movable transfer surface.

The statement that the heating means are arranged in a substantially homogeneous manner over a surface is intended to signify an arrangement by which the heating means are substantially identical per unit surface area to supply heat having substantially the same magnitude at each point of the surface. The statement that the heating means present a low thermal inertia is intended to mean that the heating means have a minimum ability to store heat energy and can thus cool very rapidly after the supply of energy to the heating means has been halted.

Then, all of the leading portion of the mass, block, or bar of thermoplastic material comes directly into contact with the heating means, and all of this leading portion across its surface melts simultaneously in order to be immediately distributed in the form of a sheet as soon as it is melted at the time that the dispenser has been placed in operation.

Preferably, the transverse cross section of the reservoir, or the receptacle, is constant over its entire depth, and the outlet and distribution surfaces are identical in form and dimensions to this transverse cross section. The advancing movement of the wax toward the heating means can then be effectuated mechanically in a constant manner across the entire cross section, and this will begin to occur as soon as the melting occurs, which is equally uniform across the transverse cross-sectional area.

Advantageously, the heating means have a good thermal conductivity, for example having a coefficient ($\lambda$) greater than 10 W/m° K. Thus, the front part of the mass, block, or bar of wax in contact with the heating means melts very rapidly and the heating means are not heated to a temperature substantially beyond the melting temperature of the wax, which permits the problems of restarting, and particularly the waiting time therefore, to be minimized.

According to a first type of embodiment, the heating means are arranged in a substantially homogeneous manner across all of the outlet surface of the reservoir, or receptacle, and comprise passages for thermoplastic material solely in the molten or flowable state, the external face of these heating means being planar and constituting the distribution surface for the molten wax in the form of a sheet on an application surface or a transfer surface.

The block or bar of material being pressed against the heating means, the melted part then flows rapidly through the passages of the heating means in order to be immediately distributed across a plane. The dispenser is useable in all positions due to the pressure means of the reservoir.

Preferably then, the heating means are a grid formed of resistive electric heating wires arranged across the entirety of the outlet surface of the reservoir.

The heating means thus correspond to a simple rectangular heating resistance having a small thickness and thus a small thermal inertia, and simultaneously provide the outlet for the reservoir and for the dispenser. This low thermal inertia particularly permits avoidance of the formation at this outlet of masses of material which are melted and then resolidified. In addition, this heating resistance is easy to fabricate and the heat dissipated thereby is easily controllable as a function of the intensity of the heating current, which determines the wax flow rate.

According to a first variation of the first type of embodiment, the outlet surface of the dispenser is rectangular and the rectangular heating grid is constituted by a mesh of electric wires supplied with a current from two electrodes each extending along the entire length or the entire height (or width) of the grid. Reference to a mesh is intended to encompass a structure in the form of a network or loosely woven fabric composed of resistive metallic wires. The length of the rectangle constituting this grid then corresponds to the width of the sheet or band which is to be spread. The mesh grid can comprise slots which extend alternatingly from opposite sides of the grid in a manner to create a sinusoidal flow path for the electric current.

According to a second variation, the grid is constituted by a series of closely parallel filaments arranged side-by-side between two electrodes each extending over the entire length or over the entire height of the grid, and thus of the outlet surface of the dispenser.

According to a third variation, the grid is constituted by a single sinusoidal resistive wire passing alternatively from one longitudinal edge to the other.

According to a fourth variation, the grid is constituted by a plurality of flat metal bars electrically connected together and the width of which bars is disposed substantially perpendicular to the surface of the grid.

According to a fifth variation, the outlet orifice is circular and the heating means are constituted by a single resistive wire arranged in a tight spiral.

The above-described range of variations permits an optimization of the heating across the entire surface of the mass, bar, or block of thermoplastic material in contact with the heating means as a function of the thermal parameters of various waxes and other thermoplastic products that may be dispensed.

According to a first specific embodiment, the means for advancing the thermoplastic material can comprise a piston having a head whose cross section is equal to or slightly less than the corresponding cross section of the reservoir and which is advanced toward the outlet of the dispenser either under the action of pushing means, such as springs, bearing on the one hand against the internal face of the piston head and on the other hand against the upstream extremity of the housing; or under the action of tension, or traction, means, such as a spiral spring whose cylinder casing is fixed to the housing close to the outlet of the reservoir and of which the elastically movable end is attached to the piston. As a result of this arrangement, the totality of the mass, block, or bar of thermoplastic material can be consumed without leaving residues which adhere to the walls of the reservoir. Usefully, the force of the pushing or tension means can be adjustable, which represents one possibility for regulating the flow rate, but above all the temperature of the molten wax.

According to a second specific embodiment, the means for advancing the thermoplastic material can comprise a base leg carrying at its forward extremity a frame containing a transverse heating grid and, if desired, a roller underlying and in proximity to the grid, and of which the rear extremity is articulated to the rear extremity of a pressure leg whose forward extremity bears on the upper section of the bar of wax, the lower section of the bar of wax resting against the grid, a spring installed between the base and pressure legs maintaining them separated in the rest state.

Usefully, the pressure leg is surmounted by a support leg which is articulated to a pivot, a spring installed between these two legs maintaining them separated in the rest state, the pressure leg comprising a switch element for interrupting the supply of current to the heating grid, the switch element being capable of being rocked by the support leg as it approaches the pressure leg.

This form of construction approaches the kinematics proven to be suitable for a stapler, i.e. it involves a handle which is to be gripped in the hand in order to be compressed for the purpose of producing the desired result, in this case the desired result being the dispensing of wax in the form of a sheet on a transfer and application roller. The dispenser in the form of such a handle has been found to be particularly convenient to use even by an inexperienced user. Although the presence of the roller is not essential, the use of such roller is nevertheless preferred to facilitate attainment of a homogeneous band.

Alternatively, the base and pressure legs are articulated in a notch at the base of a casing-handle. A crosspiece pivotally connected on the one hand at the middle of the pressure leg and on the other hand to a pivot of the base leg is capable of being lowered by an internal vertical bar of the casing and a spreading spring can be arranged between the base leg and the crosspiece.

According to a first form of construction, the outlet of the dispenser comprises means to maintain a separation, or gap, such as feet, pads, or lateral rollers, i.e. arranged along the height of the grid, to maintain the external face of the grid at a predetermined distance from the application surface. This arrangement facilitates spreading of a band having a predetermined constant thickness by the combination of the heating power delivered and the speed of displacement of the dispenser. If desired, the means for maintaining the separation, or gap, are vertically adjustable. The thickness of the band which is to be spread is then preregulated in combination with the adaptation of the heating power and/or of the displacement speed.

Additionally, the means for maintaining a separation, or gap, can comprise a small diameter roller parallel to the length of the grid (or with its axis perpendicular to the direction of displacement of the dispenser) disposed in proximity to the frontal face of the dispenser. This roller equally helps to maintain the spacing at a desired value. During displacement of the dispenser, rubbing provoked on the skin by the roller is less than that engendered by pads, resulting in greater comfort during use.

According to a second form of construction, the outlet of the distributor comprises mobile transfer and application means disposed in proximity and facing the heating grid constituting the outlet surface of the dispenser, these mobile means transporting the wax delivered in a sheet toward the application surface, for example the skin of the user, for deposition. These transfer means can be an endless band turning between two pulleys which are rotatable and are fixed to the casing at one side and the other of the distribution surface. Preferably, these means are constructed in the form of a transfer and application roller disposed a small distance in front of the distribution surface and the length of which corresponds substantially to that of the distribution surface provided by the grid.

According to one specific embodiment, the diameter of the roller corresponds to the height, or width, of the distribution surface. Then, the grid preferably has the form of a conic frustum or a portion of a cylinder to remain close to the roller.

According to a second specific embodiment, the diameter of the roller is substantially greater than the height, or width, of the distribution surface, so that the cross section of the roller facing the grid is quasi planar.

According to a second type of embodiment, the heating means are arranged in a substantially homogeneous manner in, or closely behind, a fixed section of a mobile transfer surface, this section being situated directly facing the entire outlet surface of the reservoir and constituting the sheet distribution surface, the transfer surface then bringing the sheet onto an application surface.

Preferably, the heating means are constituted by the cross section of the periphery of a transfer roller facing the outlet surface of the reservoir.

Then, melting of only the front part of the bar of wax is equally obtained in a quasi instantaneous manner throughout the extent of its contact with the roller, itself locally and directly heating at the reservoir outlet. Now, this periphery of the roller simultaneously assures a distribution in the form of a sheet, of the wax which has just been heated, leaving the following section, or slice, of the wax bar to come in a continuous manner against the heating means. Again, this heating can be achieved in a uniform manner across the entirety of the front transverse cross section of the bar, which permits the bar to be consumed progressively, one slice, or stratum, at a time.

According to a first form of construction of this second type of embodiment, the heating means comprise a series of parallel resistive electric conductors disposed on the periphery of the roller side-by-side with a regular spacing, their extremities extending around against the periphery of the roller hubs, or axial rings, as well as a pair of sliding contacts facing the conductor ends, the length of these contacts corresponding substantially to the thickness of the reservoir and of the wax bar.

According to a second form of construction, the electric conductors are constituted by longitudinal bands cut from a metallic coating, or layer, on the cylindrical periphery of the roller and the circular periphery of the hubs. Preferably, this coating is a nickel-chrome alloy, the contacts being, if desired, copper plated. This form of construction permits efficient control of the homogeneity of the resistivity of the bands and easy fabrication of these rollers on a mass production basis at a reasonable cost.

According to a third form of construction, the heating conductive bands are connected in series via their ends. This manner of connection assures a powerful heating opposite the wax bar, as well as a maintenance heating in the transfer and application part of the roller.

According to a fourth form of construction, the heating means comprise an induction loop penetrating through an open face to the interior of a metal roller held in rotation at its other face, this loop being disposed just behind the zone of the roller facing the outlet surface of the reservoir.

According to an embodiment of the dispenser adapted to the second type of embodiment, its casing is composed of a main body containing a reservoir open at its lower extremity, as well as two lateral extensions carrying the roller directly under the reservoir, as well as an upper handle sliding above the upper part of the main body, this handle comprising internal ribs bearing on the wax bar installed in the reservoir to press the wax bar toward the bottom against the roller, the body and the handle being, in the rest state, separated by a biasing means.

In a preferred manner, the manual dispenser of thermoplastic material according to the invention comprises means for regulating the electric power delivered to the heating means, which permits proportional regulation of the rate of flow of molten solder.

Advantageously, the roller is connected to a displacement sensor ($d\theta$) connected to an electronic circuit.

For example, the roller is completed by a magnetic disk presenting several pairs of poles at its periphery, for example four poles; a detector, for example a switch having flexible blades, is fixed to the body of the dispenser facing the periphery of the disk.

Preferably then, the heating means are supplied by current pulses having a predetermined duration, voltage amplitude and current intensity, corresponding to a predetermined energy content which can be adjustable, the number of pulses applied being proportional to the amount of rotation of the roller.

Thus, when the dispenser comprises either a roller for transfer and application, or a small roller associated with the arrangement of means for maintaining a gap, control of the average heating power, and thus of the quantity of melted wax, as a function of the speed of displacement of the dispenser can be achieved very simply, assuring thus equally the distribution of a band of wax having a constant thickness.

Advantageously, the distribution roller of the spacing means is driven in rotation by a motor. Advance of the dispenser on the skin is thus facilitated and more regular, causing the thickness of the band to remain very constant. Then, as a function of the desired thickness of the wax and of the available heating energy, the desired speed of the dispenser is predetermined to control the motor for driving the roller.

The invention will be better understood from a consideration of the embodiments presented by way of non-limiting example and illustrated in the attached drawings.

DETAILED DESCRIPTION OF THE INVENTION

In the following description, the term "downstream" is employed to refer to the side of the dispenser or a constituent element which is closest to the outlet, or distribution, opening, and the term "upstream" refers to the side opposite thereto. With regard to various elements of the dispenser, the phrase "internal face" refers to a face or surface which is oriented toward the interior, while the phrase "external face" refers to a face, or surface, of the same elements which is oriented toward the exterior.

Figure 1:
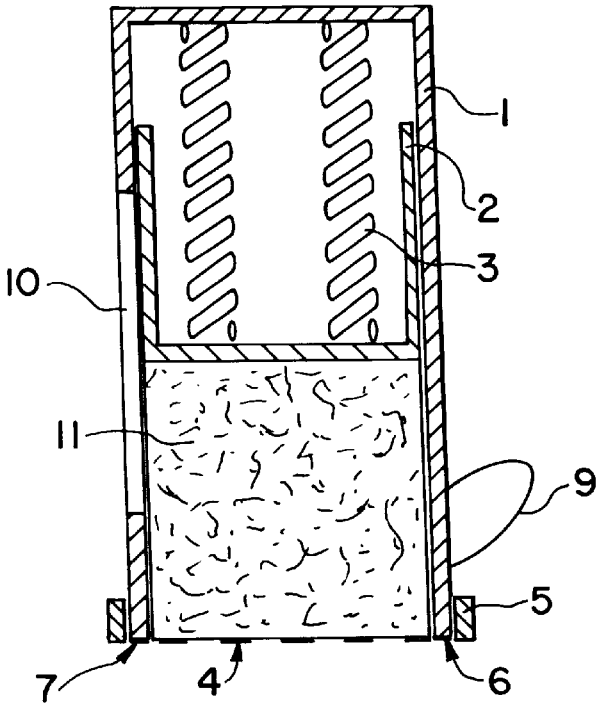
FIG. 1 is a longitudinal cross-sectional view of a first basic type of embodiment of a manual dispenser according to the invention.

The hand-held dispenser shown in FIG. 1, provided to distribute thermoplastic material such as depilatory wax, comprises a casing 1 having substantially the form of a parallelepiped which serves as a manual gripping means. The downstream end of this casing is completely open to constitute a large outlet, or dispensing, opening. At the interior of this casing is a longitudinally slidable piston having a head with a cross section equal to or slightly smaller than the internal cross section of the casing. Displacement of the piston is effectuated under the action of pressure means 3, such as one or several springs, bearing on the one hand against the internal face of the head of piston 2, and on the other hand against the internal face at the upstream end of the casing.

According to a first form of construction, a heating grid 4 is disposed across the open downstream end of casing 1 and covers the entirety of its cross section. The edges of this grid are folded, or bent, around the downstream edges of the lateral walls of the casing and are held there by a clamping ring 5.

The space between the downstream face of piston 2 and the internal face of grid 4 constitute a reservoir intended to receive wax 11. The wax may be in the form of granules, or in the form of a bar preferably coated with a lubricant such as paraffin. In this latter form, the transverse cross-section of the wax bar corresponds substantially to the internal cross-section of casing 1. The wax is introduced into the reservoir via an opening 10 provided in one of the lateral walls of casing 1. The granules or bar of wax are then pushed against the internal face of grid 4 under the action of piston 2.

A thick grid can be constituted by an undulating metallic band which, when placed on its edge, is folded on itself in a spiral and possibly following the contour of a rectangle. The length of the rectangle of this grid corresponds then to the width of the band utilized, while the height, or width, of this rectangular grid corresponds to the thickness of the wax bar contained in the reservoir. The external face of this grid thus constitutes the outlet surface of the dispenser.

According to a first specific form of construction illustrated in FIG. 1, this grid 4 is made of an expanded metal, such as stainless steel or titanium having a small thickness, of the order of 0.1 to 0.2 mm, and its structure is of the type of a tight mesh, each opening defining a molten wax passage. By way of example, the openings are square, their sides measuring substantially 1.5 mm. When the wax is present in the form of granules, the cross-section of the granules is then substantially greater than the cross-section of the openings of the grid.

As illustrated in FIG. 1, such a grid constitutes a rectangular heating resistance serving as heating means for the wax. This resistance is supplied with electric current via terminals, or electrodes, 6 and 7 disposed opposite one another and either over the entire length, or over the entire height, of the grid. The height of the grid is the dimension which is perpendicular to the grid length in the plane of the outlet surface. A manual control 9 acting on a switch or a relay (not shown) controls the passage or interruption of current through the grid.

Figure 2:
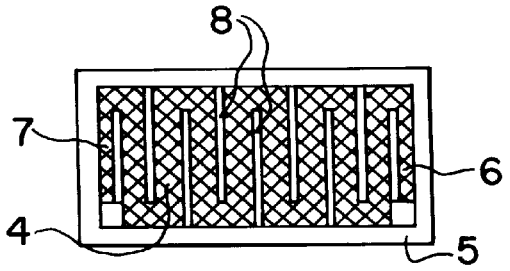
FIG. 2 is an end view of the wax outlet of the dispenser of FIG. 1 equipped with one type of heating grid.

By way of a variant, and in order to increase the electric resistance, grid 4 can be pierced by vertical slots 8, as shown in FIG. 2. These slots are of very small width, on the order of 1 mm, and have for their effect to reduce the transverse cross-section of passage of the current and to increase the length of the electric current flow path, which thus establishes a meandering, or sinusoidal, path between electrodes 6 and 7. A current of reasonable intensity, on the order of several amperes, can thus be utilized while being supplied between electrodes 6 and 7 by a very low and, hence safe, voltage.

Figure 3A:
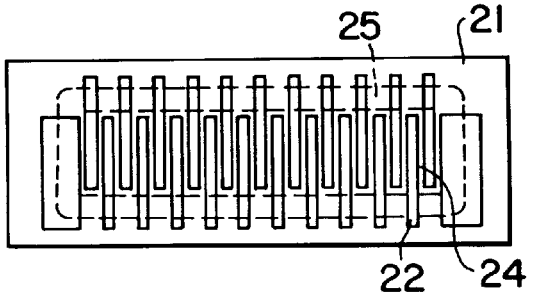
FIGS. 3*a* and 3*b* are end views illustrating one manner of fabricating another embodiment of a heating grid which can be employed in the dispenser of FIG. 1.
Figure 3B:
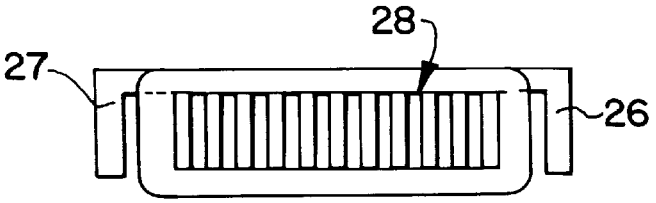

In a further variant, this increase in the path of the current can be obtained in a simple manner by means of a flexible resistive wire having successive curves, the path followed by such a wire having, for example, the form of a sinusoid, or serpentine. In a further variant, the grid can equally be formed of stamped metal, as illustrated in FIGS. 3*a* and 3*b*. For this purpose, a rectangular metal sheet or plate 21 is cut to form a series of side-by-side openings 22, leaving, between adjacent openings, only a thin band, or blade, 24. In addition, all of the successive openings 22 are longitudinally offset from one another with an identical gap, or spacing. In other words, if the openings were numbered successively, starting from one end, one could say that the even numbered openings are longitudinally shifted relative to the odd numbered openings. Plate 21 is then overmolded on a rectangular frame 25. Frame 25 has two longitudinal edges, which extend horizontally in FIG. 3. The odd-numbered openings extend from a point just above the lower longitudinal edge to a point above the upper longitudinal edge of frame 25. The even-numbered openings extend from a point just below the upper longitudinal edge to a point below the lower longitudinal edge of frame 25. After this overmolding, the structure has the form shown in FIG. 3*a*. Then, plate 21 is again cut along the two longitudinal edges of frame 25 to leave only a grid 28 constituted by bands 24 electrically connected in series alternately at the top and bottom of grid 28, this grid being completed by two lateral electrodes, or terminals, 26 and 27, as shown in FIG. 3*b*.

Plate 21 is constituted by a thin metal sheet, made for example of stainless steel having a thickness of the order of 0.2 mm. This sheet is initially cut, or stamped to have thin bands 24 with a width of 0.4 mm, bands 24 being disposed parallel to one another with a spacing of 2 mm. Frame 25 extends through plate 21 in the spaces which are produced by the cutting. After overmolding of frame 25, sheet 21 is cut to have the form shown in FIG. 3*b* so that bands 24 form a series circuit.

Despite the thinness of bands 24, the resulting grid easily supports the force exerted by a wax bar on bands 24, partly because the ends of bands 24 are embedded in frame 25 and are thus held in position.

The only material from the original sheet 21 which remains in the finished grid between electrodes 26 and 27 consists of thin bands 24 which form a series circuit. Only the right-hand band 24 is connected physically to electrode 26 and only the left-hand band 24 is connected physically to electrode 27.

It will be noted that when plate 21 is cut to form bands 24, there are also formed tongues, or tabs, each such tab being integral with two adjacent bands 24. These tabs will be embedded in overmolded frame 25 and will therefore serve to prevent any relative movement of bands 24. When plate 21 is cut in the manner shown in FIG. 3*b*, the connections which originally existed between the tabs on each side of the structure are broken.

In a variant illustrated in FIGS. 11*a*, 11*b*, 12*a* and 12*b*, grid 4 can be constituted by several flat metal bars 200, advantageously parallel to one another, and electrically connected to one another. Each bar has a width which extends perpendicular to the major surface of the grid and parallel to the direction of flow of melted wax through the grid. This configuration facilitates the flow of wax through grid 4 because the cross-section of metal bars 200 perpendicular to the direction of wax flow is very small. The length of time during which wax is in contact with grid 4 while passing through grid 4 is substantial, which avoids the need to overheat the wax. The quantity of depilatory wax which is directly heated is substantial, which permits a quasi instantaneous melting action. The temperature uniformity is thus very satisfactory for the application of the wax.

Figure 11A:
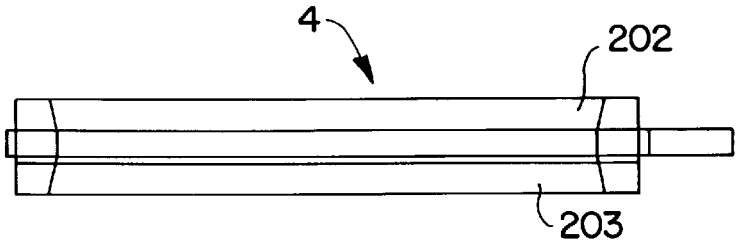
FIGS. 11*a* and 11*b* are, respectively, a lateral cross-sectional view and a front view of an embodiment of a heating grid which can be employed in the dispenser of FIG. 1.
Figure 11B:
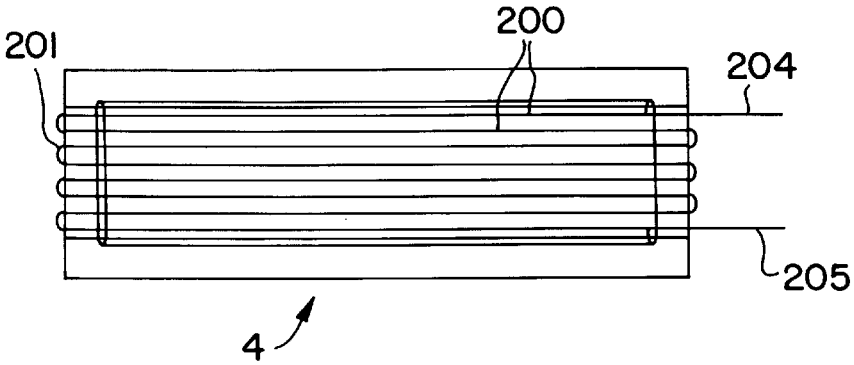

According to the examples shown in FIGS. 11*a* and 11*b*, grid 4 is formed of a heating ribbon 201 disposed in a zigzag, or serpentine, pattern between two frames 202 and 203 of electrical insulating material. Ribbon 201 thus provides a series of parallel metal bars 200, the two extremities of ribbon 201 forming electrodes, or terminals, 204 and 205.

Figure 12A:
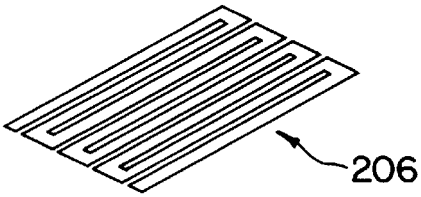
FIGS. 12*a* and 12*b* are perspective views illustrating two stages in the fabrication of a further embodiment of a heating grid which can be employed in the dispenser of FIG. 1.
Figure 12B:
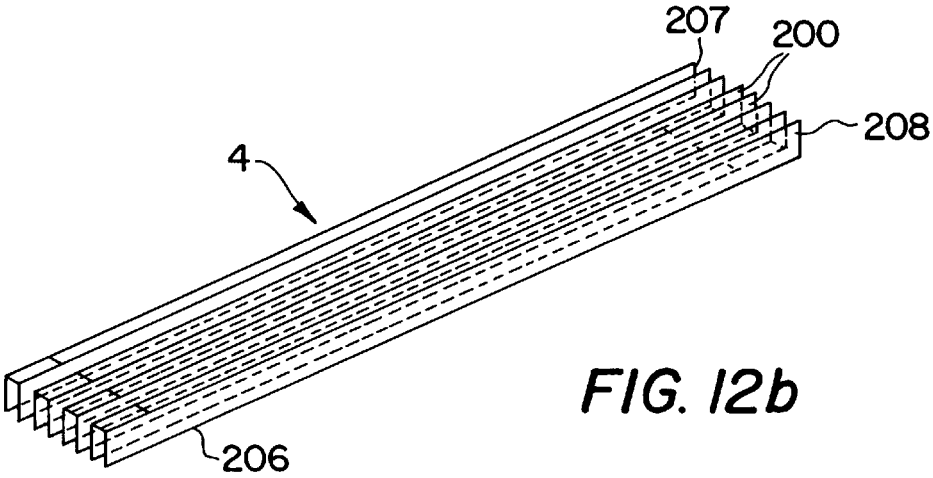

According to the examples shown in FIGS. 12*a* and 12*b*, grid 4 is formed by a sheet 206 stamped to leave a serpentine, or zigzag strip, as shown in FIG. 12*a*, and then folded, or pleated, to define a series of parallel metal bars 200, as shown in FIG. 12*b*. The two extremities of stamped metal bars 200 form two electrodes, or terminals, 207 and 208. Sheet 206 can be inserted into an electrically isolating frame, not shown in the Figures, for example by overmolding an appropriate moldable material around sheet 206. Advantageously, bars 200 of FIGS. 12*a* and 12*b* are thin bars having a width of the order of 2 mm and the thickness of the order of 0.2 mm. If grid 4 is composed of eight metal bars 200, each 40 mm long with a spacing of 1 mm between adjacent metal bars 200, such a grid would permit a melting, at the rate of 0.55 g/s, of wax initially present in the form of a bar having a rectangular cross-section, parallel to the surface of grid 4, of the order of $40\times10$ mm$^2$ with a heating power of the order of 55 watts.

Figure 5:
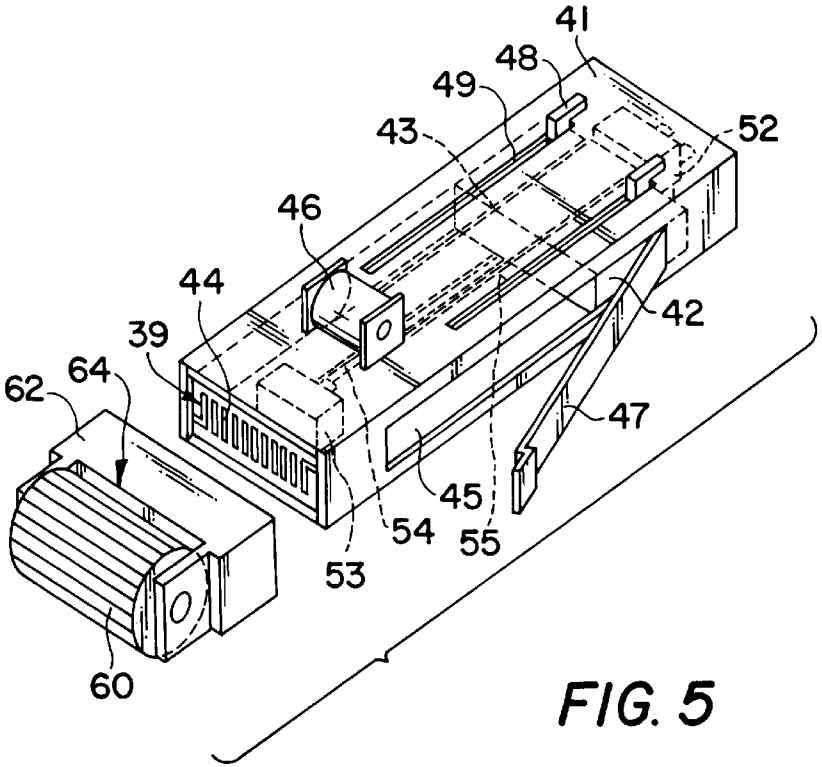
FIG. 5 is a partly exploded perspective view, looking from the bottom, of a third embodiment of a dispenser according to the invention.

In another variant illustrated in FIG. 5, grid 44 can also be fabricated in the form of a series of parallel resistances between two longitudinal supply electrodes. This grid is equally made of a metal by stamping a series of side-by-side openings in a metal sheet, leaving only a fine band, or blade of metal between adjacent openings. At each end of grid 44 there is an opening having the form of an L, thus forming, at the longitudinal ends of grid 44, two lateral electrodes each provided with a connection element for a respective electric supply wire 39.

In one form of construction or the other, the source of heating current for the grid is a step down transformer, possibly having plural stages, followed by an electronic current switching supply circuit permitting adjustment of the average heating current supplied to grid 4. Other electric supply devices, such as those utilizing a rheostat, or a potentiometer, can be used to adjust the electric power delivered to grid 4. Preferably, the current source is housed in a power supply having an AC input cord connected to a conventional power mains receptacle and having an outlet connected by an electric cable to the dispenser, but the current source can also be integrated into casing 1 as is currently done in instant soldering irons, for example.

Preferably, the heating current source is connected to a power mains receptacle, commonly referred to as a wall receptacle in a building, and acts to step down the voltage from the power mains. This voltage reducing current source can be an electronic converter, known examples of which are relatively light, and can be integrated into the appliance. In the present state of the art, it does not appear that a self-contained power source, i.e. a power source composed of batteries, would be suitable for appliances of the type disclosed herein. However, it is conceivable that further development of battery technology would result in the production of batteries which are sufficiently small and light to be integrated into these appliances.

It is in order to note that the grids described have a small thickness or are produced from bands having a small thickness and that, their constituent material having a good thermal conductivity, they also present a low thermal inertia. Materials having a good thermal conductivity for achieving the objectives of the invention include materials in which heat can be rapidly transferred from one point to another. For example, most metals have a thermal conductivity coefficient, $\lambda$, greater than 10 W/m° K. With regard to materials having a suitably low thermal inertia, these are constituted by materials having a poor ability to accumulate heat, for example having a mass thermal capacity, $C_p$, lower than 0.4 kJ/(kg·° K). Thus, the grids according to the invention retain practically no heat energy. Suitable materials satisfying the desired criteria have been identified above.

The hand-held dispenser shown in FIG. 1 operates and is used in the following manner.

A bar of wax 11 is introduced into the dispenser via opening 10, after piston 2 was preliminarily retracted in opposition to the action of spring 3 by a manual control (not shown). After introduction of wax 11, piston 2 is released so that, in response to the action of spring 3, piston 2 comes to push the solid wax 11 against the internal face of grid 4.

Acting on the control 9, an electric current supply circuit is completed to deliver heating current to grid 4 so that grid 4 will be heated almost instantaneously. This heat is transmitted immediately to the wax in contact with grid 4 as a result of the good thermal conductivity of the material constituting grid 4. When this portion of the wax reaches its melting temperature, the melted wax flows rapidly through the passages of grid 4 and then past the external face of grid 4, constituting the outlet orifice and outlet surface of the dispenser. During this flow, the temperature of the grid exceeds the melting temperature of the wax only by several degrees. Spring 3 and piston 2 push against the rear end of the bar of wax 11, producing a flow of the transverse portion of the melted wax and thus bringing the following transverse portion, or stratum, of the wax, which is still solid, into contact with the internal face of grid 4 for heating and then melting of the new transverse portion of the wax until it achieves its flowable, or liquid, state. The distribution of molten wax is thus effectuated in a continuous manner. Above all, the thermal exchange remains very localized in contact with this grid, which makes it unnecessary to melt the totality of the wax bar, as in known dispensers. The user displaces the dispenser transversely on the skin while bringing the grid almost in contact with the portion of the skin being treated. This operation, which provokes flow of the fluid wax in the form of a band, is free of any risk of burning because of the thinness of the band of wax being spread. When the supply of heating current to grid 4 is halted, by acting on control 9, the electric power being delivered to grid 4 is terminated and the flow of wax halts almost instantaneously. In effect, the low thermal inertia of the grid causes it to cool immediately after termination of the supply of electric current, which avoids undesired melting of the wax layer which is then in contact with grid 4 and which at that time is still in the solid state. In addition, the grid has been adapted in such a manner that any part of casing 1 which is susceptible of being a thermal reservoir is not heated.

In the operating mode, the user can control the thickness of the band by acting either on the speed of displacement of the dispenser, or on the electric power delivered to grid 4 when grid 4 constitutes the outlet end of the dispenser.

In effect, all of the heat developed electrically in grid 4 is transferred only into the portion of the wax bar in contact therewith, the thermal conductivity of the wax being inherently low. The molten wax flowing rapidly out of the grill under the action of the pressure applied to the wax, the grid is always in contact with wax in the solid state, and the temperatures of the wax and of the grid only exceed by a small amount the melting temperature of the wax. The thermal losses are very limited since the transfer of heat remains very localized. Thus, the flow rate of wax is directly proportional to the electric power delivered to the grid in accordance with the equation:

$$W=p\,Q_v C_p \Delta T,$$

where

W is the electric power delivered to the grid, p is the volumetric mass of the wax, $Q_v$ is the volumetric flow rate of the wax, $C_p$ is the mass heat capacity of the wax.

In this term and in order to simplify, use can be made of a value $C_p$ (equivalent) which accounts for the heat of fusion $L_f$ extending on the scale of ambient temperature to melting temperature, or $L_f/\Delta T$. This is obtained by solving the equation: $C_p$ (equivalent)$=C_p+L_f/\Delta T$, and $\Delta T$ is the temperature difference between ambient temperature and the wax melting temperature.

Since melting does not occur abruptly, the temperature of the melted wax depends, for a given wax, on its rate of flow through grid 4. The slower the flow, the more the temperature of the wax is increased.

Thus, by acting on the electric power delivered to grid 4, for example by means of a rheostat, the user can, for the same speed of displacement of the dispenser on the skin, apply bands which are more or less thick.

Conversely, when the electric power is established at a predetermined value, and all other things being moreover constant, the wax flow rate $Q_v$ is also constant once the user begins operation of the dispenser. This flow rate can be expressed as the following product:

$$Q_v=L\cdot e\cdot V,$$

where

L is the length of the grid, this dimension being in the outlet surface, or plane, of the dispenser and perpendicular to the direction of displacement of the dispenser on the skin, e is the thickness of the film to be produced on the skin during displacement of the dispenser with the grid very close to the skin, and V is the speed of displacement of the dispenser on the skin, this speed being measured by its component perpendicular to the width of the dispenser, which is perpendicular to the above-mentioned length of the grid.

Thus, if the user displaces the dispenser at a high speed, this produces a is relatively thin film; if, to the contrary, the dispenser is advanced slowly, the resulting film will be thicker. The user thus can easily control the thickness of the wax band and can form thick bands, which are useful for depilatory treatment of various body parts, such as the arm pits.

It should moreover be noted that the pushing force exerted on the wax bar is of an order of magnitude substantially greater than the force of gravity, which allows the dispenser to be easily used in any spatial orientation. One can in addition envision providing the dispenser with a device which permits regulation of the pressure means, which constitutes a complementary means for controlling the flow of molten wax and assuring that it has an acceptable temperature at a constant electric power delivered to the grid and a constant dispenser displacement speed.

Figure 4:
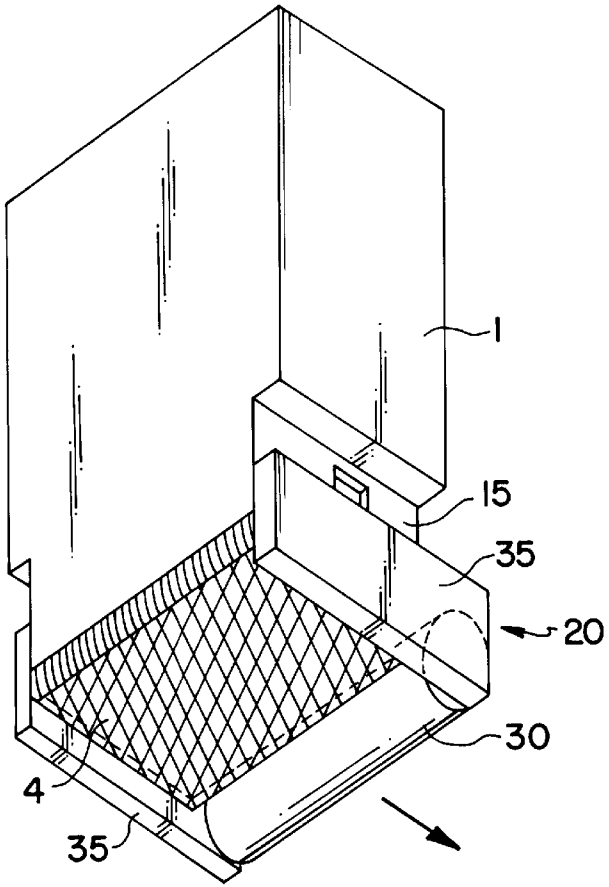
FIG. 4 is a perspective view, looking from the bottom, of a second embodiment of a dispenser according to the invention.

According to a further form of construction illustrated in FIG. 4, there is disposed, at lateral sides of the dispenser grid 4, two pads, or runners, 35 permitting grid 4, which constitutes the outlet surface of the dispenser, to be maintained at a predetermined distance from the application surface, in this case the application surface being the user's skin. These pads 35 help to establish a constant thickness value for the deposited layer. Correspondingly, these pads 35 can be mounted on the lateral faces of casing 1 via conventional mechanisms, such as pawls, which allow the distance between the lower surfaces of pads 35 and the outlet surface defined by the external face of grid 4 to be adjusted.

More specifically, each side of casing 1 has a recess, or notch, 15 at the level of the outlet surface of the dispenser. In this recess 15 is installed a moveable assembly 20 composed of the two pads 35 and a small transverse roller 30 supported by pads 35.

This roller 30 is disposed in a manner such that the lowest axially extending generitrix of its outer surface coincides substantially with the lower surfaces of pads 35 which define the spacing, or gap, between the outlet surface of the dispenser and the user's skin. This roller 30, which is located at the forward end of movable assembly 20 with respect to the correct direction of displacement of the dispenser on the user's skin, or more specifically in front of grid 4, engenders, by its rotation during its displacement on the skin, a lower level of friction than that induced by a transverse pad. Alternatively, each of the pads can be constituted by a series of aligned rollers. In this case, transverse roller 30 is not absolutely necessary.

When in use, and depending on the vertical position to which movable assembly 20 has been adjusted, the thickness of the wax band will be more or less large for a given electric heating power and speed of displacement.

According to the specific embodiment illustrated in FIG. 5, a casing 41 has the form of a flattened right rectangular parallelepiped with an open front face in which is installed grid 44. Grid 44 is connected to receive current via supply wires 39. Most of the space enclosed by casing 41 constitutes a reservoir 45 within which a piston 42 is slidably mounted. This reservoir is accessible by opening a lateral door 47 for insertion of a block of wax.

More particularly, in this embodiment, piston 42 is pulled forward, i.e. in the direction of grid 44, by the extremity of a spiral spring 43 which is movable against the upstream internal face of casing 41, exiting to the outside via a slot to arrive at an associated housing cylinder 46 fixed on an external face of casing 41 in proximity to the frontal face of casing 41. With respect to the view of FIG. 5, housing cylinder 46 is fixed to the upwardly facing external face of casing 41. Housing cylinder 46 provides an envelope which protects spring 43 and facilitates its mounting on casing 41. As piston 42 is pulled forward, spiral spring 43 will be wound about an axis provided by housing cylinder 46. Fingers 48 of piston 42 pass through longitudinal slots 49 which permit piston 42 to be withdrawn toward the rear in opposition to the action of spiral spring 43 when necessary. Alternatively, a tension spring mounted on a support shank arranged along one of the lateral walls of casing 41 can be envisioned, this wall presenting a slot for a finger for attaching the piston to the spring. These arrangements permit the total length of the dispenser to be reduced in comparison with the embodiments shown in FIG. 1.

A beginning of travel path interrupter switch 52 is installed at the upstream external face of casing 41 to the rear of piston 42 by which switch 52 is controlled. Switch 52 prevents heating of grid 44 when piston 42 is withdrawn to the rear, notably during loading of a wax plate and operates to initiate supply of heating current when piston 42 moves away from switch 52. A second, end of travel path, interrupter switch 53 is arranged under casing 41 in proximity to grid 44. An actuation element 55 fixed to piston 42 and passing through casing 41 via a lower longitudinal slot 54 moves along a path which enables it to activate switch 53 when substantially all of the wax has been consumed and piston 42 itself comes into contact with grid 44.

This dispenser could be utilized in the form described, or in combination with an application roller 60 mounted in a hollow hood 62, hood 62 being fittable to the front end of casing 41. Hood 62 is either fixed permanently to casing 41 or is removable therefrom. When hood 62 is mounted, grid 44 will be at a small distance from roller 60. As a result of the thermal characteristics and the arrangement of grid 44, wax hardens only at the level of grid 44 immediately after the electric supply is turned off. This small amount of wax is remelted almost instantaneously when operation is restarted. Moreover, the interstice between roller 60 and the edge 64 of hood 62 defines a calender for regulating the thickness of the wax which is to be deposited on the skin.

Figure 6A:
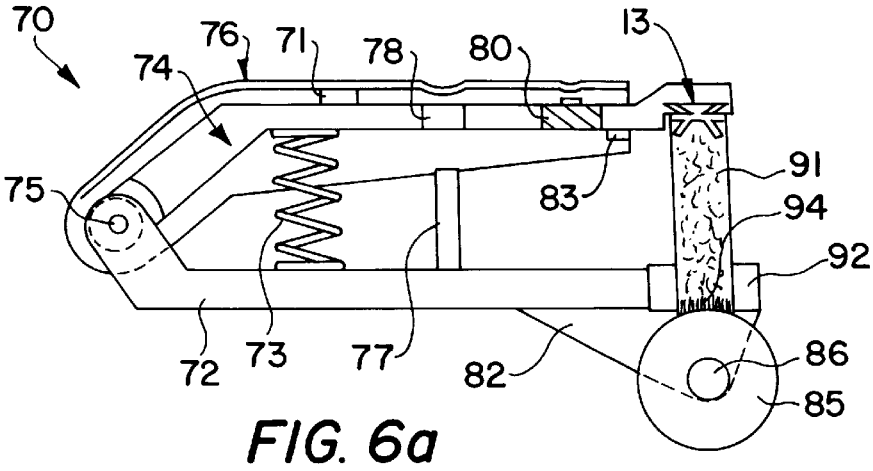
FIGS. 6*a* and 6*b* are, respectively, a longitudinal cross-sectional view and a transverse cross-sectional view of a further embodiment of the dispenser according to the invention.
Figure 6B:
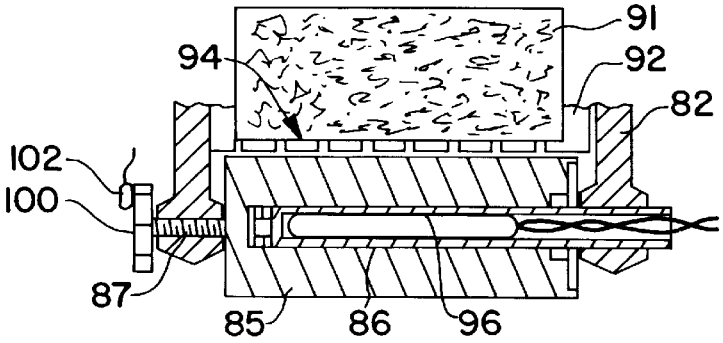

According to another embodiment illustrated in FIGS. 6*a* and 6*b*, the dispenser is in the form of a handle 70 compressible in a manner analogous to that of a stapler. A base leg, or branch, 72 carries at its front extremity a transfer and application roller 85 having an axis, or shaft, 86 which is held at one end and the other by two lateral supports 82. This extremity of leg 72 also carries a frame 92 containing a transverse heating grid 94. At its rear extremity, leg 72 is articulated by a hinge 75 to a pressure leg, or branch, 74 situated at the interior of a bearing leg, or branch, 76 which envelops leg 74 and is also pivoted on hinge 75. Pressure leg 74 follows the movements of the bearing leg 76 modified by flexure experienced by a spring 71.

Pressure leg 74 carries a switch 80 which is activated by a protrusion on bearing leg 76 when the latter is lowered while compressing spring 71. The front extremity of pressure leg 74 comes to rest on the upper layer of a wax bar 91. The lowest layer of bar 91 rests in frame 92 and bears against grid 94. Preferably the wax bar is marketed with a dovetail tenon 13 extending along the entire length of the upper layer of bar 91, this tenon being slidably installed in a dovetail mortise arranged in a corresponding position in the front extremity of pressure leg 74. The resulting connection permits bar 91 to be maintained in the housing of the dispenser constituted by the space between the extremities of the base and bearing legs, and also permits bar 91 to be moved away from grid 94 in response to a retracting force produced by a leg separating spring 73.

An abutment 77 mounted on base leg 72 and traversing pressure leg 74 via an orifice 78 permits descending movement of bearing leg 76 to be limited when the front extremity thereof is close to frame 92.

As is most clearly visible in FIG. 6*b*, roller 85 turns freely due to its mounting in ball bearings which extend around its fixed tubular shaft 86 suspended from leg 72. In shaft 86 there is embedded a complementary heating resistance 96, which is preferably temperature controlled to maintain roller 85 at a temperature just sufficient to maintain the wax band on the outer surface of roller 85 in a softened state. Moreover, roller 85 is extended by a shaft 87 supporting a magnetic disk 100. Disk 100 has several pairs of poles at its periphery, for example four pairs. A detector 102, for example an interrupter switch having flexible blades, is fixed on a corresponding support 82 of the dispenser, with detector 102 being in proximity to disk 100. This interrupter switch is closed when a pole passes in proximity thereto, which permits observation of the rotation of the disk, and thus of the roller. Devices for detecting rotational movement of such a magnetic disk are, of course, well known in the art.

Preferably, grid 94 is supplied with electrical energy pulses having a duration, voltage level and current intensity which are predetermined to prevent an undesirably rapid melting of the wax in place, the quantity of energy then being proportional to the number of pulses delivered per unit of time. At the start of operation of such a dispenser, a pulse containing determined first quantity of energy is applied in the beginning to trigger melting of the lower part of the wax.

The quantity of energy subsequently applied is proportional to the rotation of the roller as detected by detector 102. The pulses are closer together as the roller turns more rapidly. If the roller is stopped, heating also stops.

Utilization commences by separating the pressure and bearing legs 74, 76 from the base leg 72, aided in this regard by the action of spring 73, in order to insert a wax bar by introducing the tenon 13 into the corresponding mortise in the extremity of pressure leg 74. The user then closes the dispenser casing (not shown) and then grips the dispenser by gripping in one hand the legs 72 and 76. When these legs are squeezed together, they pivot relative to one another about the axis of hinge 75.

When bar 91 comes in contact with grid 94, pivotal movement of leg 74 halts, while leg 76 continues to be lowered against the restoring force of spring 71 until switch 80 has been closed. The downward force applied to wax bar 91 is then, in a certain manner, controlled by the behavior of spring 71. Closing of switch 80 allows the passage of electric current into grid 94, with a first energy pulse to trigger melting of the wax and subsequent pulses regulated in an automatic manner as a function of the rotation of roller 85. As the front part of the wax bar 91 melts, it passes through grid 94 and wets roller 85. Roller 85, while rotating in contact with the skin, deposits a band of wax thereon.

When wax bar 91 is consumed, bearing leg 76 arrives in contact against abutment 77. Spring 71 expands while continuing to urge pressure leg 74 downwardly until leg 74 is halted by a stop 83 carried by bearing leg 76. Switch 80, then opens to discontinue the supply of electric current to grid 94. When the operator releases their grip on the legs of the dispenser, spring 73 tends to separate base leg 72 from pressure leg 74, as a result of which the remaining end of wax bar 91 detaches from grid 94 and is withdrawn therefrom. Then, this remainder of wax bar 91 can be removed and replaced with a fresh bar in order to allow operation of the dispenser to be resumed.

Figure 6C:
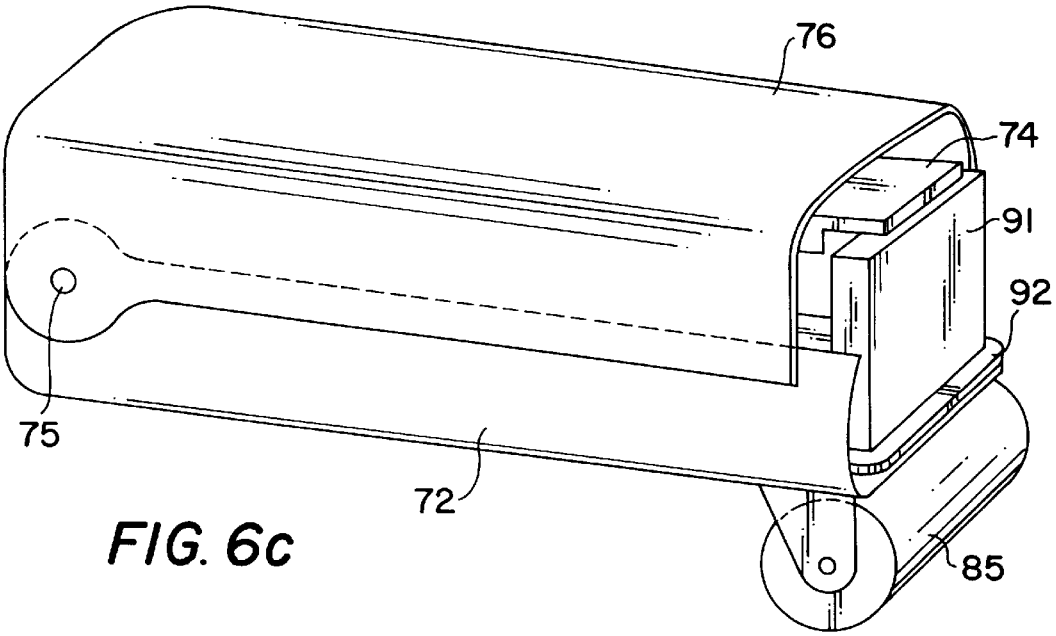
FIG. 6*c* is a perspective view of a modified version of the embodiment of FIGS. 6*a* and 6*b*.

FIG. 6*c* is a perspective view showing a developed version of the embodiment of FIGS. 6*a* and 6*b*. In the version shown in FIG. 6*c*, the sides of bearing leg 76 are extended downwardly, and the sides of base leg 72 are extended upwardly, so that each of these legs has a U-shaped cross section. In this form, legs 72 and 76 simultaneously provide a casing for the appliance.

Figure 7:
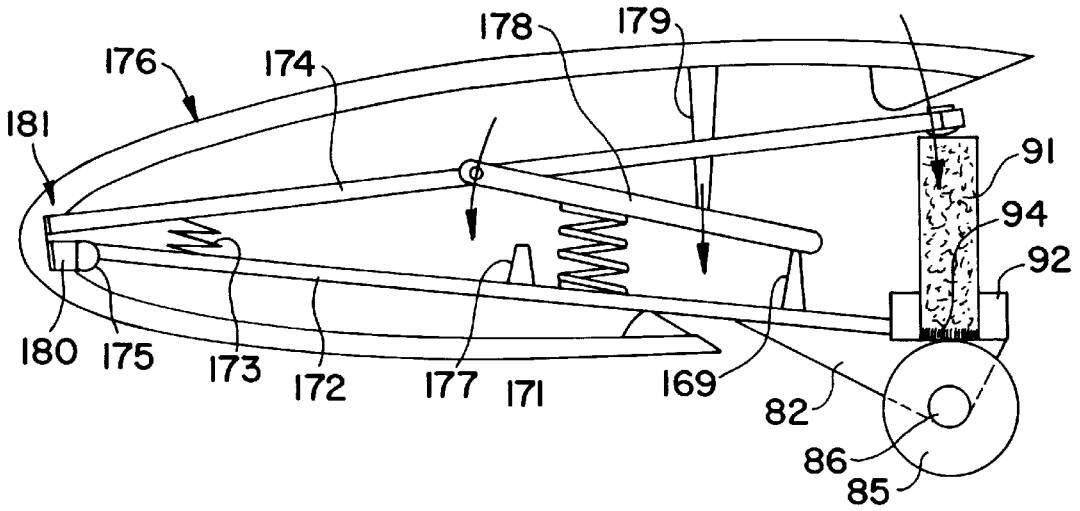
FIG. 7 is a longitudinal cross-sectional view of a further embodiment of the dispenser according to the invention.

FIG. 7 illustrates a further embodiment of the invention bearing certain similarities to the embodiment shown in FIGS. 6*a* and 6*b*. In the embodiment of FIG. 7 the kinematic linkages of the legs is somewhat modified to permit a better control of the bearing force which forces the wax bar against the grid. As previously, there is a base leg 172 having a rear extremity which is articulated by pivot 175 to the base of a housing-handle 176 which performs the function of a bearing leg. Housing-handle 176 additionally constitutes an external portion of the dispenser and is thus constructed to additionally perform a decorative function. Base leg 172 carries, at its front end, frame 92 carrying transverse heating grid 94, as well as transfer roller 85 located beneath grid 94. Here again, the axis of rotation 86 of roller 85 is carried by two lateral supports 82. A pressure leg 174 has a front end which rests on the upper end of wax bar 91 and is maintained by its rear end against the upper face of a notch 181 situated at the level of the pivot point of base branch 172. Maintenance of pressure leg 174 in its desired position is assured by a compression spring 173 acting between pressure leg 174 and base leg 172. At the lower face of notch 181, a switch 180 is installed under the rear end of pressure leg 174.

Pressure leg 174 is pivotally connected, at a point between its extremities, to the rear end of a cross piece 178. Cross piece 178 has a front end which is maintained in a lowered state against a fulcrum 169 of base leg 172 by a vertical bearing bar 179 forming an internal component of housing-handle 176. Cross piece 178 is acted on by the upper end of a compression spring 171 whose lower end rests on base leg 172. Downward movement of cross piece 178 is limited by an abutment 177.

To use the dispenser shown in FIG. 7, the user grasps enveloping housing-handle 176 of the dispenser, in this case without any risk of prematurely triggering melting of the wax because the user is not directly gripping base leg 172. On the other hand, when roller 85 is placed on the application surface and the user imposes a manual pressure tending to urge the two legs of housing-handle 176 toward one another, bar 179 presses against the cross piece 178, causing cross piece 178 to move pressure leg 174 downwardly until the rear extremity of pressure leg 174 comes to bear against switch 180 and actuates switch 180. Only then does an electric heating current pass through grid 94. Subsequent downward movement of cross piece 178 causes pressure leg 174 to undergo a pivoting movement about its rear extremity which is then resting on switch 180. As a result, the front extremity of leg 174, which bears against the upper end wax bar 91, is urged downwardly as the lower end of wax bar 91 is melted.

Figure 7A:
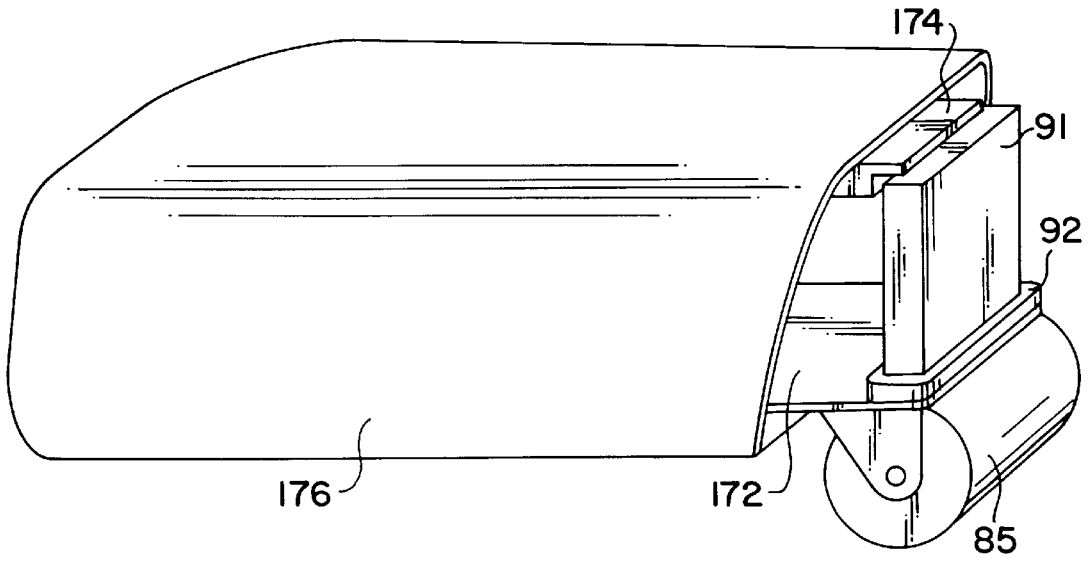
FIG. 7*a* is a perspective view of a modified version of the embodiment of FIG. 7.

FIG. 7*a* is a perspective view of a developed version of the embodiment of FIG. 7, in which the sides of housing-handle 176 are extended downwardly so that housing-handle 176 simultaneously constitutes a casing for the appliance.

Figure 8A:
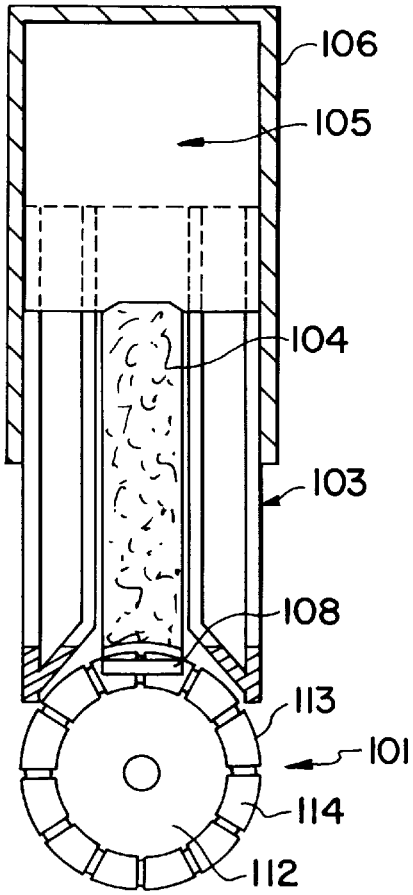
FIGS. 8*a* and 8*b* are, respectively, front and side elevational cross-sectional views of a second basic type of dispenser according to the invention.
Figure 8B:
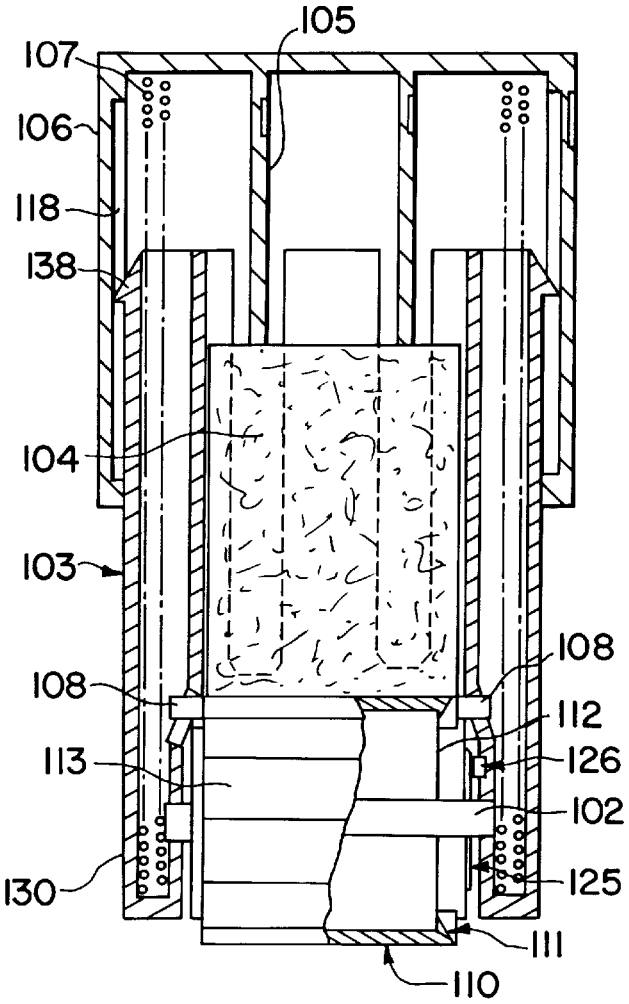

According to a second basic type of embodiment illustrated in FIGS. 8*a* and 8*b*, the dispenser includes a roller 101 for transfer and application of melted wax. A particular feature of roller 101 is that the portion of its periphery which directly faces the outlet of the reservoir, i.e., the outlet surface, constitutes the homogeneous, or uniform, heating means for the entire front transverse section of wax bar 104.

In this embodiment, the casing is composed of two pieces which slide relative to one another, these including a main body 103 and a handle 106 surmounting and covering the upstream end of main body 103. Lugs 138 extend outwardly from the upper edges of body 103 and engage in corresponding grooves arranged in the internal face of handle 106. The cooperation between lugs 138 and grooves 118 avoids unintentional separation of these parts from another.

The lateral faces of body 103 are extended toward the bottom by two hollow extensions 130 between which a horizontal shaft, or axle, 102 of a freely rotatable roller is mounted. Internal ribs of body 103 define an internal vertical reservoir whose lower end opens onto the upper axial generatrix of roller 101. This reservoir is dimensioned and intended to receive a wax bar 104 having the general form of a parallelepiped, and preferably a right rectangular parallelepiped, having a relatively small thickness. Bar 104 is held in the reservoir in such a manner than an end layer of bar 104 will bear against the upper peripheral zone of roller 101. The walls of the reservoir have a pair of vertical slots, as can be seen in FIGS. 8*a* and 8*b*. These slots receive ribs 105 which form part of handle 106 and are arranged to push wax block 104 against roller 101 as a result of a manual force exerted on handle 106 by the user. Moreover, two vertical springs 107 act between the bottoms of hollow extensions 130 of body 103 and the upper internal face of handle 106 in a manner to urge handle 106 and body 103 apart when the dispenser is not in use. When handle 106 and body 103 are urged away from one another, wax block 104 is liberated from the downward force otherwise produced by ribs 105.

In particular according to this second basic type of embodiment according to the invention, roller 101 is constituted by a hollow cylinder 110 presenting at each extremity a radial ring 111 which is oriented toward the interior. Within each ring 111, there is inserted a disk 112 of an electrically insulating material different from that of cylinder 110. Disks 112 are mounted for rotation on shaft 102 and thus perform the function of hubs.

Cylinder 110 and rings 111 are made of a material having a low thermal inertia and, according to a first form of construction, are provided with a series of parallel resistive electric conductors, or resistances, oriented in the longitudinal direction of roller 101, i.e. parallel to axial generatrices of the periphery of roller 101. These conductors are thus disposed on the periphery of the cylindrical body, in a side-by-side arrangement with a regular spacing between them around the roller circumference. The ends of the conductors are turned over against the ring. Each conductor extremity is folded in the form of a terminal on the corresponding ring. According to one form of construction illustrated in FIGS. 8, the periphery of roller 110 and the periphery of rings 111 are externally coated with a conductive metal deposit. For example, roller 110 can be of a plastic material, such as polycarbonate, and the deposited metal is a nickel-chrome alloy. This deposit has a small thickness, of the order of several microns, or even a submicron thickness, to present a sufficiently high electrical resistance. The metal deposit is regularly slit throughout its entire thickness along planes containing the axis of rotation of shaft 102 so as to provide heating resistance bands 113 which are separated from one another by narrow slits and are thus electrically insulated from one another. Each end of each band forms a contact, or terminal, 114 on a respective ring 111. Contacts 114 serve as current collectors. Advantageously, contacts 114 which cover rings 111 are copper plated to be thicker and have a lower resistance than the remainder of heating resistances 113. As an alternative, the conductive material deposited on each ring 111 is continuous around the periphery of the ring, i.e. is free of any slits and is smooth.

Two sliding contacts 108 are arranged in the upper parts of hollow extensions 130, each contact 108 being disposed adjacent a respective end of roller 101. As best shown in FIG. 8*a*, each contact 108 has a length, in a direction perpendicular to the direction of displacement of wax bar 104 in the reservoir and perpendicular to the longitudinal axis of shaft 102, which corresponds substantially to the thickness of the reservoir and of the wax bar. Contacts 108 are stationary and slidably engage terminals 114 when roller 101 is rotating, in a manner to supply current only to the band or bands 113 momentarily in contact with the downwardly facing front edge of wax bar 104. There is thus created, in an elegant manner, a heating surface on the periphery of the rotatable roller 101 uniquely in the zone which directly faces the outlet surface.

Figure 9:
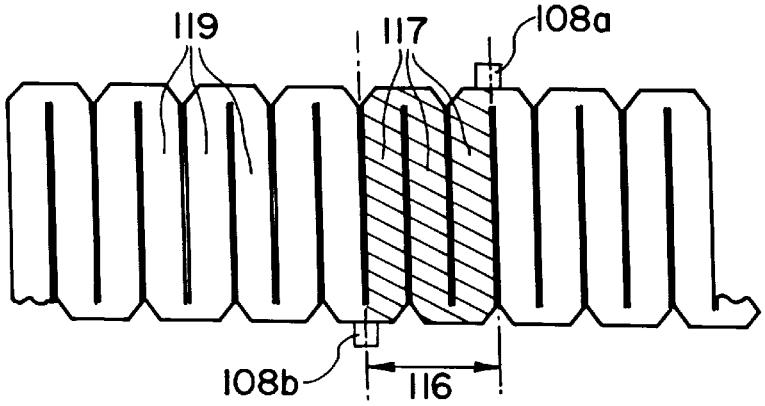
FIG. 9 is an elevational view of another embodiment of heating means which can be utilized in the dispenser of FIGS. 8*a* and 8*b*.

According to another form of construction, all of the conductive bands on the periphery of the roller are connected in series by the interconnection of their terminals in a manner such as that illustrated in FIG. 9. Then, two narrow contacts 108*a* and 108*b* mainly supply several conductive bands 117 defining the heating zone 116 which is situated to directly face the outlet surface. Because of this series connection, the other bands 119 are also supplied with current. However, since the current flow path defined by these other bands is considerably longer, and thus has a higher resistance, substantially more current flows through the bands in region 116 and the electric power dissipated in the other bands 119 is relatively small. The power dissipated in bands 119 is, in fact, preferably just sufficient to maintain the external surface of the roller at a temperature suitable for maintaining the wax, after it has been melted, in an appropriate flowable state during its transfer to the skin's surface. This result can be achieved by giving bands 117 and 119 an appropriate resistivity, in combination with a suitable selection of the electric current parameters. Typically, the electrical power dissipated in heating zone 116 across the entire associated cross section of the wax bar is of the order of 70 to 100 watts, permitting a rapid and regular melting of the wax. However, since the roller is not thermally inert, switching off of the flow of current from the heating means brings about a very rapid halt in the melting of the front part of the wax bar, thus preventing subsequent blockage of the remote part since only a fine film of wax possibly remains on the roller.

Figure 10A:
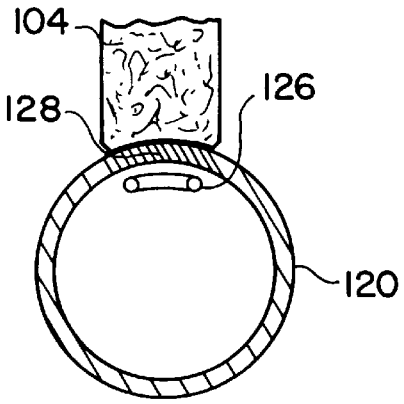
FIGS. 10*a* and 10*b* are, respectively, transverse and longitudinal cross-sectional views of a roller for a dispenser according to a further embodiment of the invention.
Figure 10B:
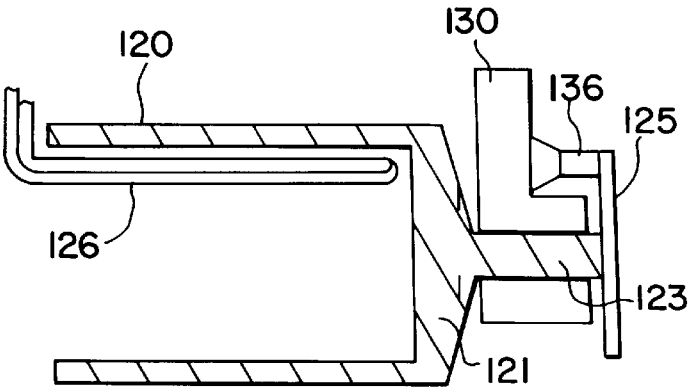

According to a further form of construction according to the second basic type of embodiment, which form of construction is illustrated in FIGS. 10*a* and 10*b*, the roller is constituted by a cylindrical tube 120 closed at one end by a bottom, or disk, 121 that is fixed to a shaft 123. This roller is thus supported for rotation in a cantilever manner on one extension 130 of the dispenser body. Tube 120 is of an electrically conductive material. The other extension 130 of the dispenser body (not shown) carries an elongated induction loop 126 which penetrates into the region enclosed by tube 120 via the open end thereof. Loop 126 is located just behind a zone 128 of tube 120, which zone directly faces the reservoir outlet, and thus the front edge face of wax bar 104. Then, current flowing through loop 126 locally induces eddy currents in zone 128 of tube 120 in order to locally heat zone 128 at the location where the front end of wax bar 104 comes into contact with tube 120. Sufficient heating can be achieved by supplying a power level of the order of 50 to 100 watts, which will permit the front section of the wax in contact with zone 128 to be rapidly melted.

According to a further improvement of this form of construction, either roller 101 of FIGS. 8 or roller 120 of FIGS. 10 can be completed by a magnetic disk 125 mounted to rotate with the axial shaft of the roller. Disk 125 has a plurality of, for example 4, pairs of poles at its periphery. Correspondingly, a detector 136, which may be an interrupter switch with flexible blades, is fixed to an extension 130 of the dispenser body at the side where disk 125 is mounted, detector 136 facing the periphery of disk 125. This detector generates a signal each time a pair of poles passes in proximity to the blades of switch 136.

Then, in order to control the quantity of wax which is melted on a segment of the roller, the resistive heating zone of FIGS. 8 or the inductive heating zone of FIGS. 10 is supplied with energy in the form of current pulses. The voltage and current intensity of the heating energy are preferably fixed and the quantity of energy delivered per pulse is thus proportional to the pulse duration. There will be as many pulses as there are rising or descending signals delivered by the sensor. Each pulse delivers the energy necessary to melt the wax coating one sector of the roller, the angular extent of the sector corresponding to the angular rotation associated with one pulse from the signal generator. The number of imaginary sectors is equal to the number of pulses that can be produced by the signal generator in one revolution of the roller.

At the start of operation of the dispenser, a first predetermined quantity of energy is delivered to permit initiation of the melting of the front part of the bar of wax and freeing of the roller for rotation. Then, the number of pulses per unit time, and thus the intensity of heating is preferably determined proportionally with the speed of rotation of the roller. For example, detector 136 controls heating of the zone of the roller by the intermediary of a time relay generating energy pulses during each passage signal. The pulses are then closer together as the speed of the roller increases. If the roller halts, heating also halts.

It is in order also to note that in modifying the characteristic values of the pulses, one can augment or reduce the heating power for a given speed of advance, which then translates into a voluntary modification, by the user, of the thickness of the layer of wax spread.

Thus, poor results due to unskilled utilization of the appliance, such as melting of the wax within the reservoir and blockage of the appliance by wax which has melted improperly, are substantially minimized. Moreover, since the active heating element of the roller is remote from the user's skin, the risks of burning in case of malfunction or unskilled utilization are minimized.

Obviously, devices for detecting the speed of the roller and automatic control of the associated heating power described with reference to FIGS. 8 and 10 are equally applicable to the roller according to FIG. 5, and also to the small roller of the space maintaining arrangement of FIG. 4.

One can equally envision motorizing the rollers or small wheels, which serve the function of means for controlled advance of the dispenser. This motorizing can comprise a gear train mounted along a lateral wall of the housing to come to engage in an outlet pinion of a rear electric motor. Then, one can equally control the speed of rotation of the roller (or displacement of the dispenser) as a function of the desired wax band thickness and of the electric power delivered to the grid.

It should be readily apparent that electronic circuits for controlling the generation of heating pulses in response to the output of a detector, such as detector 136 of FIG. 10*b* can be easily constructed on the basis of principles already well known in the art.

In appliances according to the invention in which the supply of heating current is controlled in response to rotation of the roller, at the start of operation, there can be supplied an adjustable energy pulse having a duration of the order of 600–900 msec. Then, in response to each detection signal, as provided by contacts 108 after each 1/8 revolution of the roller, a further energy pulse having a duration of the order of 200–460 msec is supplied to the heating element.

Figure 13:
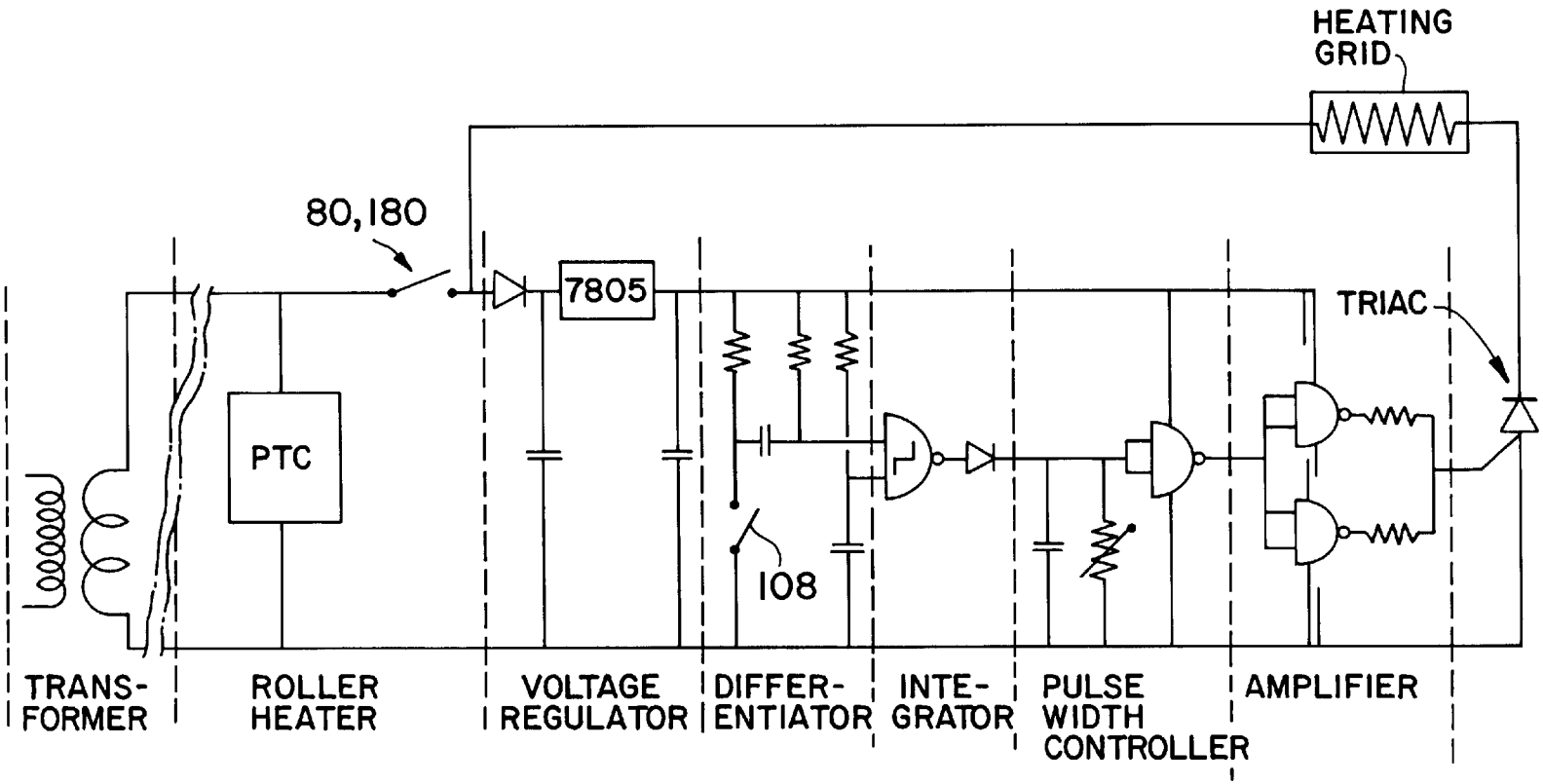
FIGS. 13 and 14 are circuit diagrams of two embodiments of electronic circuits which can be employed for controlling the delivery of heating current in appliances according to the invention.

FIG. 13 illustrates one embodiment of a control circuit which can be used in the embodiment shown, for example, in FIGS. 6*a* and 6*b*. In this circuit, a transformer has its primary connected to the power mains, while the secondary of the transformer is connected in parallel with a roller heating resistance, such as resistance 96. This resistance may be of the type having a positive temperature coefficient so that the resistance varies as its temperature increases. The secondary of the transformer is further connected, via a switch, such as 80 or 180, to a voltage regulator, followed by a differentiator, an integrator and a pulse width controller. The differentiator includes contacts 108. The output of the pulse width controller is connected to an amplifier which supplies a control signal to a Triac, which controls the power delivered to the heating grid. In the embodiment shown in FIG. 13, heating current is continuously supplied to resistance 96 as long as the appliance is turned on. The amplifier supplies a series of turn-on pulses to the Triac.

Figure 14:
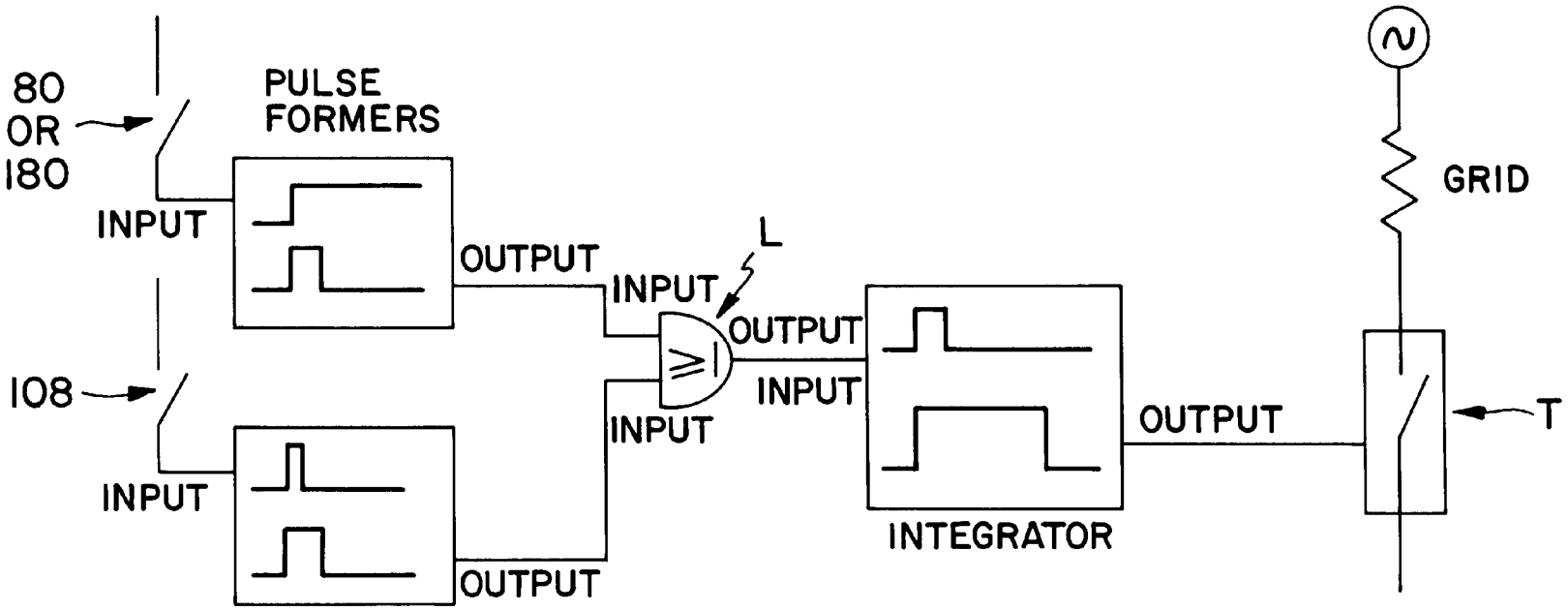

FIG. 14 is a block diagram of a digital embodiment of an electronic control circuit according to the invention which includes two pulse formers, one of which has an input connected to switch 80 or 180, and the other of which has an input connected to contacts 108, the other ends of switch 80 or 180 and of contacts 108 being connected to a suitable potential source. Each time switch 80 or 180 is closed, the upper pulse former generates an output pulse having a fixed duration. Similarly, each time contacts 108 are closed, in response to rotation of the associated roller, the lower pulse former generates an output pulse having a fixed duration.

The outputs of the two pulse formers are supplied to respective inputs of an OR gate L, so that this gate will produce an output each time either of the pulse formers produces an output pulse. The output from gate L is delivered to the input of an integrator, which produces an output pulse having a selected duration in response to each input pulse. The output pulse from the integrator is applied to control the closing of a circuit defined by a heating power control element T. Element T is connected in series with the heating grid and the series circuit formed by the grid and element T are connected across an AC voltage source, such as the secondary of the transformer shown in FIG. 13.

The width of each output pulse produced by the integrator can be controlled by a suitable electronic adjustment devices.

The electronic circuits shown in FIGS. 13 and 14 can be employed with any of the embodiments in which the supply of heating power is controlled in response to rotation of the roller. For those embodiments which do not include continuous internal roller heating of the type shown in FIG. 6*b*, the roller heater element shown in FIG. 13 can be omitted. In the embodiment of FIG. 13, the width of each pulse supplied to the Triac is intended to be manually controlled, for example by means of an additional dial on the casing of the appliance.

As regards the wax which may be employed in dispensers according to the invention, one preferred type of wax is disclosed in commonly owned U.S. Pat. No. 5,556,468. It should be understood, however, that any other thermoplastic depilatory wax can be dispensed from dispensers according to the invention. In addition, virtually any other type of thermoplastic material can be dispensed by dispensers constructed in accordance with the present invention.

This application relates to subject matter disclosed in French Application number 96 12209, filed on Oct. 2, 1996, the disclosure of which is incorporated herein by reference.

While the description above refers to particular embodiments of the present invention, it will be understood that many modifications may be made without departing from the spirit thereof. The accompanying claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

What is claimed:

1. A hand held dispenser for thermoplastic material, comprising:

a casing forming a manual holding means, said casing enclosing a material holding space for receiving a mass of thermoplastic material initially in a solid state, said casing having an open outlet end communicating with said space, said open outlet end defining an outlet surface through which the thermoplastic material flows out of said material holding space;

means for advancing the thermoplastic material toward the open end of said casing; and heating means for heating the thermoplastic material to a flowable state, wherein said heating means are arranged in a substantially homogeneous manner substantially parallel to said outlet surface and have dimensions which correspond to dimensions of said outlet surface, and further wherein said heating means further constitute means for distributing thermoplastic material in a flowable state in the form of a sheet on a receiving surface.

2. The dispenser according to claim 1, wherein said material holding space has a length extending perpendicular to said outlet surface and a constant cross section throughout said length, and further wherein said outlet surface has a cross section substantially identical to the cross section of said material holding space.

3. The dispenser according to claim 1, wherein said heating means are thermally conductive.

4. The dispenser according to claim 3, wherein said heating means have a thermal conductivity coefficient, $\lambda$, greater than 10 W/m° K.

5. The dispenser according to claim 1, wherein: said heating means extend in a substantially uniform manner across the entirety of said outlet surface; said heating means are provided with passages for permitting flow of the thermoplastic material only when the thermoplastic material is in a flowable state; and said heating means have an external surface which coincides with said outlet surface.

6. The dispenser according to claim 5, wherein said heating means comprise a grid formed of resistive electric heating wires extending across the entirety of said outlet surface.

7. The dispenser according to claim 6, wherein said outlet surface and said grid are rectangular, and said grid is constituted by a mesh of wires and two electrodes extending across two opposed sides of said grid and connected for supplying electric current to said wires.

8. The dispenser according to claim 7, wherein said grid is provided with a plurality of slots which extend in alternation from two opposite sides of said grid.

9. The dispenser according to claim 6, wherein said grid comprises a plurality of mutually parallel filaments side-by-side and two electrodes substantially coextensive with at least one of the dimensions of said grid and connected for supplying electric current to said filaments.

10. The dispenser according to claim 6, wherein said grid is constituted by a plurality of flat metal bars which are electrically connected together, each of said bars having a width which extends substantially perpendicular to said outlet surface.

11. The dispenser according to claim 10, wherein said heating means further comprise two electrically insulating frames between which said bars are sandwiched, and said bars are connected together in series and extend along a serpentine path to form a heating ribbon.

12. The dispenser according to claim 10, wherein said grid is formed from a metal sheet which is cut to form said bars, said bars are connected together in series and extend along a serpentine path, and said metal sheet is folded so that said bars extend parallel to one another.

13. The dispenser according to claim 10, wherein said grid is composed of eight bars, each of said bars being 40 mm long, 2 mm wide and 0.2 mm thick, and said bars are parallel to one another and spaced apart by a distance of 1 mm.

14. The dispenser according to claim 5, wherein said material holding space has a constant cross section parallel to said outlet surface, and said means for advancing the thermoplastic material comprise a piston having a piston head with a cross section not greater than the cross section of said material holding space, and pushing means for advancing said piston toward said outlet surface, said pushing means being supported between an internal face of said piston head and an internal surface of said casing.

15. The dispenser according to claim 5, wherein said material holding space has a constant cross section parallel to said outlet surface, and said means for advancing the thermoplastic material comprise a piston having a piston head with a cross section not greater than the cross section of said material holding space, and traction means for exerting a traction force on said piston, said traction means having a first end fixed to said casing at a location proximate to said outlet surface and having a second, elastically mobile end attached to said piston.

16. The dispenser according to claim 5 wherein the thermoplastic material is a bar of wax having a lower end and an upper end, and said means for advancing the thermoplastic material comprise:

a base leg having a front end and a rear end;

a frame carried by said front end of said base leg and supporting said heating means;

a pressure leg having a front end and a rear end, said rear end of said pressure leg being articulated to said rear end of said base leg, said front end of said pressure leg being located to bear against the upper end of the bar of wax while the lower end of the bar of wax rests against said grid; and a spring interposed between said base leg and said pressure leg for urging said front end of said pressure leg away from said front end of said base leg.

17. The dispenser according to claim 16, further comprising a roller disposed directly said heating means grid and having a periphery defining the receiving surface.

18. The dispenser according to claim 5, further comprising means disposed below said outlet surface for maintaining a predetermined spacing between said outlet surface and the receiving surface.

19. The dispenser according to claim 5, further comprising mobile transfer and application means having a surface which forms the receiving surface, the receiving surface being disposed in proximity to, and facing, said outlet surface.

20. The dispenser according to claim 19, wherein said mobile transfer and application means comprise a transfer and application roller having an axial length which is coextensive with a corresponding dimension of said outlet surface.

21. The dispenser according to claim 20, further comprising a displacement sensor mounted for sensing rotational movement of said roller and for providing an output signal representative of roller displacement, said displacement sensor comprising a magnetic disk mounted for rotation with said roller and having a periphery provided with a plurality of pairs of magnetic poles, and a detector which is fixed to said casing and which faces the periphery of said disk.

22. The dispenser according to claim 21, further comprising a source connected for supplying electric heating energy in the form of current pulses to said heating means, each of said pulses having a predetermined duration, voltage amplitude and current level and each of said pulses having an adjustable energy content.

23. The dispenser according to claim 22, wherein the number of current pulses applied to said heating means is proportional to the amount of rotation of said roller as measured by said displacement sensor.

24. The dispenser according to claim 20, further comprising a source connected for supplying electric heating energy to said heating means, said source applying an energy pulse to said heating means prior to the start of rotation of said roller.

25. The dispenser according to claim 1, further comprising mobile transfer and application means having a surface which forms the receiving surface, the receiving surface being disposed in proximity to, and facing, said outlet surface, and wherein said heating means extend in a substantially homogeneous manner relative to a section of the surface of said transfer and application means, which section is substantially fixed in position relative to said heating means and directly faces the entirety of said outlet surface, said section constituting the receiving surface and said transfer and application means being operative to transfer thermoplastic material in a flowable state from said receiving surface to an application surface.

26. The dispenser according to claim 25, wherein said transfer and application means comprise a transfer roller and said heating means are constituted by said section of said transfer and application means.

27. The dispenser according to claim 26, wherein said surface of said transfer and application means constitute a peripheral surface of said roller and said heating means comprise a series of electrical resistance elements extending parallel to one another and disposed on said periphery of said roller in a side-by-side manner, with a uniform spacing between said resistive elements, and further wherein said periphery has two axial ends, said roller further comprises radially extending rings at said axial ends of said periphery, said resistance elements have end portions which are bent against said rings, and said heating means further comprise a pair of sliding contacts arranged to make contact with said end portions of said resistance elements, each of said contacts having a length corresponding substantially to a corresponding dimension of said outlet surface.

28. The dispenser according to claim 27, wherein said resistance elements are constituted by longitudinal bands which are formed by cutting a metal layer preliminarily formed on said periphery of said roller and on said rings, said bands being connected together in series by their end portions.

29. The dispenser according to claim 26, wherein said heating means comprise an induction loop enclosed by said periphery of said roller, said roller is made of metal, and said loop is positioned in line with said section of said roller.

30. The dispenser according to claim 25, wherein the thermoplastic material is a bar of wax, said casing comprises:

a main body enclosing said material holding space and delimiting said open outlet end, said main body having an upper end remote from said outlet end and further having two lateral extensions at opposite sides of said outlet surface, said extensions supporting mobile transfer and application means directly below said outlet surface;

a handle slidably mounted on said main body at said upper end of said main body, said handle having internal ribs disposed to bear against the bar of wax when the bar of wax is disposed in the space for urging the bar of wax toward said outlet surface; and biasing means for urging said handle relative to said main body in a direction away from said mobile transfer and application means.

31. The dispenser according to claim 1, further comprising means for supplying electric energy to said heating means, and means for controlling the electric energy supplied to said heating means.

32. The dispenser according to claim 1 wherein said heating means have a low thermal inertia.

33. The dispenser according to claim 1 wherein said heating means are disposed in the path along which thermoplastic material flows out of said material holding space.

34. The dispenser according to claim 1 wherein said heating means are provided with a plurality of passages through which thermoplastic material flows out of said material holding space.

* * * * *